US010689912B1

(12) United States Patent
Nguyen

(10) Patent No.: US 10,689,912 B1
(45) Date of Patent: Jun. 23, 2020

(54) SEALED BEARING ROCK BIT WITH A LOW PROFILE SEAL

(71) Applicant: PDB Tools, Inc., Grapevine, TX (US)

(72) Inventor: Nam Duy Nguyen, Lewisville, TX (US)

(73) Assignee: PDB Tools, Inc., Grapevine, TX (US)

( * ) Notice: Subject to any disclaimer, the term of this patent is extended or adjusted under 35 U.S.C. 154(b) by 0 days.

(21) Appl. No.: 16/712,223

(22) Filed: Dec. 12, 2019

(51) Int. Cl.
*E21B 10/22* (2006.01)
*E21B 10/25* (2006.01)
*E21B 10/24* (2006.01)

(52) U.S. Cl.
CPC ..... *E21B 10/25* (2013.01); *E21B 10/22* (2013.01); *E21B 2010/225* (2013.01)

(58) Field of Classification Search
CPC ..... E21B 10/22; E21B 10/25; E21B 10/24; E21B 2010/225
USPC ..... 277/589
See application file for complete search history.

(56) References Cited

U.S. PATENT DOCUMENTS 3,663,073 A 5/1972 Bronson
3,944,306 A 3/1976 Neilson
4,209,890 A 7/1980 Koskie, Jr.
4,213,656 A 7/1980 Huber et al.
4,248,484 A 2/1981 Newcomb
4,359,113 A * 11/1982 Morris ..... E21B 10/22 175/337
4,431,066 A 2/1984 Cunningham et al.
4,516,641 A 5/1985 Burr et al.
4,610,452 A 9/1986 Dirienz et al.
4,753,304 A 6/1988 Kelly, Jr. et al.
4,813,502 A 3/1989 Dysart
4,824,123 A 4/1989 Chia et al.
4,923,020 A 5/1990 Kelly, Jr. et al.
5,129,471 A 7/1992 Maurstad et al.
5,295,549 A 3/1994 Dolezal et al.
5,360,076 A 11/1994 Kelly, Jr. et al.
5,524,718 A 6/1996 Kirk et al.
5,655,611 A 8/1997 Dolezal et al.
6,033,117 A 3/2000 Cariveau et al.
(Continued)

FOREIGN PATENT DOCUMENTS

WO WO2008077278 7/2008

OTHER PUBLICATIONS patbase.com; Translation of WO2008077278; Apr. 5, 2012.

*Primary Examiner* — Cathleen R Hutchins
(74) *Attorney, Agent, or Firm* — Mark W Handley; Handley Law Firm, PLLC

(57) ABSTRACT

A sealed bearing rock bit has a plurality of legs with journals formed to extend inward and downward at the end of the legs. Each of the legs has a last machined surface located adjacent to the bases of the journals and into which a seal groove is formed which circumscribes the respective journal. Cutters are rotatably mounted to respective ones of the journals, with back faces of the cutters located adjacent to respective ones of the last machined surfaces. The back faces of the cutters have annular-shaped protrusions which extend from said back faces and protrude into the seal grooves beyond the last machined surfaces of said journals extending an annular-shaped seal surface which is engaged by a seal disposed in the seal groove, leaving more of the interface space between the journal and the cutter for larger roller bearings.

18 Claims, 3 Drawing Sheets

(56) References Cited

U.S. PATENT DOCUMENTS

| | | | | |
|---|---|---|---|---|
| 6,209,185 | B1 | 4/2001 | Scott | |
| 6,247,545 | B1 | 6/2001 | Burr et al. | |
| 6,336,512 | B1 | 1/2002 | Siracki et al. | |
| 6,533,051 | B1 | 3/2003 | Singh et al. | |
| 7,086,487 | B2 | 8/2006 | Nguyen | |
| 7,188,691 | B2 | 3/2007 | Yong et al. | |
| 7,311,159 | B2 | 12/2007 | Lin et al. | |
| 7,392,862 | B2 | 7/2008 | Zahradnik et al. | |
| 7,413,037 | B2 | 8/2008 | Lin et al. | |
| 7,681,889 | B2 | 3/2010 | Tsuboi et al. | |
| 7,721,827 | B2 | 5/2010 | Gallifet et al. | |
| 2006/0243494 | A1* | 11/2006 | Koltermann | E21B 10/25 175/228 |
| 2009/0045585 | A1* | 2/2009 | Gallifet | E21B 10/25 277/403 |

* cited by examiner

SEALED BEARING ROCK BIT WITH A LOW PROFILE SEAL

TECHNICAL FIELD OF THE INVENTION

The present invention relates in general to earth boring bits, and in particular to rotary cone rock bits having sealed journal bearings to which cutters are mounted.

BACKGROUND OF THE INVENTION

Earth boring bits such as rock bits for the oil field and mining industries have long been provided by rotary cone rock bits. The rotary cone rock bits have a bit body with an upper end adapted for connection to a drill string and typically three bit legs which extend downward from the body to provide support arms. A bearing shaft or journal extends inward and downward from each bit leg. A conventional rock bit journal is cylindrical and is rotatably received in a rotary cutter provided by a cutter cone. The cutter cone is generally mounted on each journal and supported rotatably on bearings acting between the journal and the inside of a journal-receiving cavity in each cutter cone. The cutter cones have teeth, inserts or compacts on their exteriors for disintegrating earth formations as the cones rotate on the journals, with weight applied to the rock bit. One or more fluid nozzles are often formed on the underside of the bit body. The nozzles are typically positioned to direct drilling fluid over the cones to wash away cuttings and cleanse the cutter cones.

A space between the journals and the cutters are sealed such that drilling fluids will not enter into the space and so that lubricant will be maintained between the journals and the cutters. A journal bearing seal prevents the lubricant between the cutter and the journal from being lost which will greatly increases the service life of the drill bit. Some of the interface space between the journal and the cutter is taken by the journal bearing seals, leaving less of the interface space for roller bearings located parallel to the axial lengths of the journals.

SUMMARY OF THE INVENTION

A sealed bearing rock bit has a plurality of legs with journals formed to extend inward and downward at the end of the legs. Each of the legs has a last machined surface located adjacent to the bases of the journals and into which a seal groove is formed which circumscribes the respective journal. Cutters are rotatably mounted to respective ones of the journals, with back faces of the cutters located adjacent to respective ones of the last machined surfaces. The back faces of the cutters have annular-shaped protrusions which extend from the back faces and protrude into the seal grooves beyond the last machined surfaces of the journals. This results in extending a length of an annular-shaped seal surface which 3wengages a seal element disposed in the seal groove, and leaving more of the interface space between the journal and the cutter for use of larger roller bearings.

DESCRIPTION OF THE DRAWINGS

For a more complete understanding of the present invention and the advantages thereof, reference is now made to the following description taken in conjunction with the accompanying Drawings in which

FIG. 1 is a longitudinal section view of one of leg of the sealed bearing rock bit having a low profile seal, a journal is shown extending downward and inward from a lower portion of the leg, and a cutter is shown rotatably mounted to the journal;

FIG. 2 is an enlarged, partial longitudinal section view of the leg of the sealed bearing rock bit of FIG. 1 showing the cutter rotatably mounted to the journal;

FIG. 3 is an exploded, partial, longitudinal section view of the base of the base of the journal and the back face of the cutter of the sealed bearing rock bit of FIG. 1; and FIG. 4 is an enlarged partial section view of the cutter of the sealed bearing rock bit, showing a cross-section of an annular-shaped protrusion which extends from the back face of the cutter for inserting into the seal groove.

DETAILED DESCRIPTION OF THE INVENTION

Figure 1:
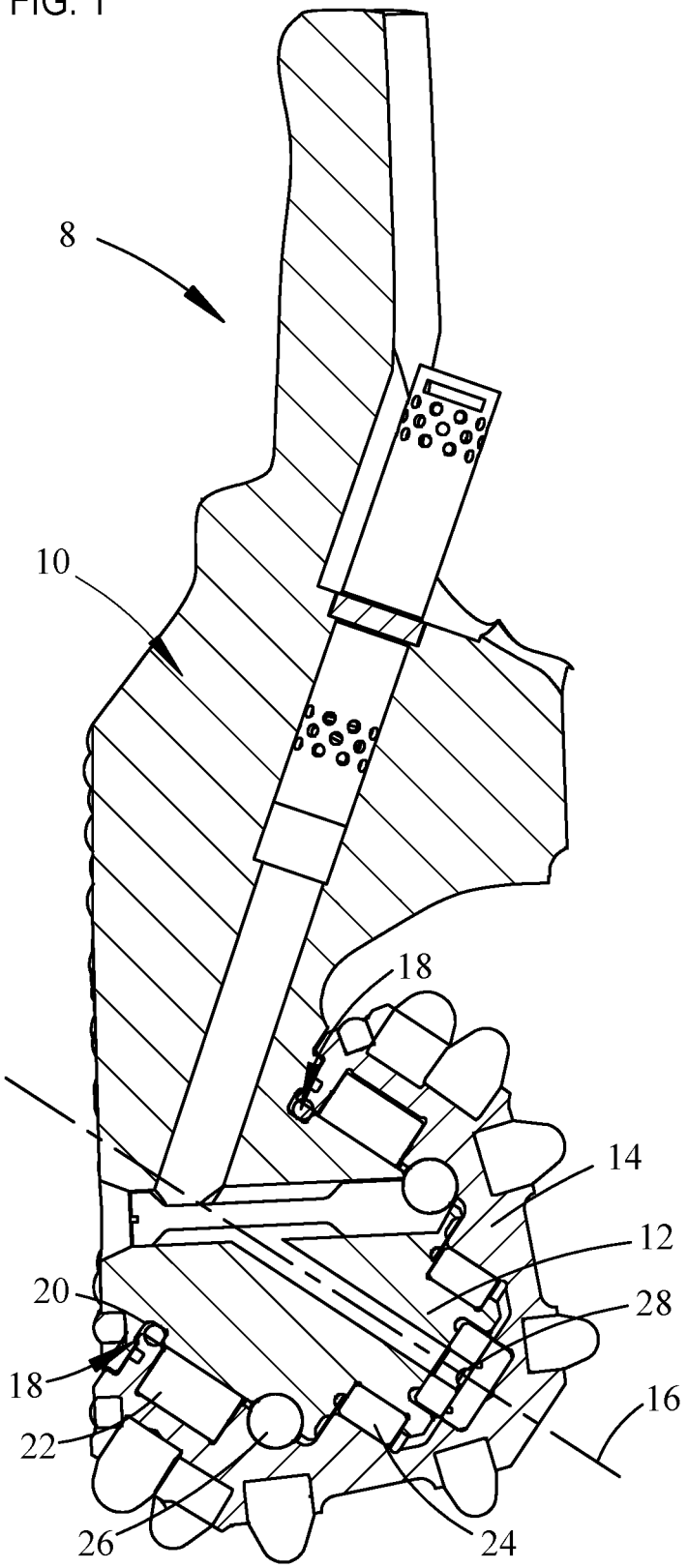
FIGS. 1 through 4 show various aspects for a sealed bearing rock bit with a low profile seal made according to the present disclosure, as set forth below.

Referring to the Figures, FIG. 1 is a longitudinal section view of one of leg 10 of a rock bit 8 having low profile bearing seal 18. The leg 10 has a journal 12 which is shown extending downward and inward from a lower portion of the leg 12. A cutter 14 is rotatably mounted to the journal 12 for rotating about a longitudinal axis 16 of the journal 12. An interface extends between the journal 12 and the cutter 14 in which are disposed roller bearings 22 and 24, and a thrust bearing 28. The roller bearings 22 and 24, and the thrust bearing 28 extend between the cutter 14 and the journal 12, parallel to the longitudinal axis 16. The bearing seal 18 extends circumferentially around the base of the journal 12 for sealing between the cutter 14 and the journal 12 and retaining grease and other lubricants between the journal 12 an the cutter 14.

Figure 2:
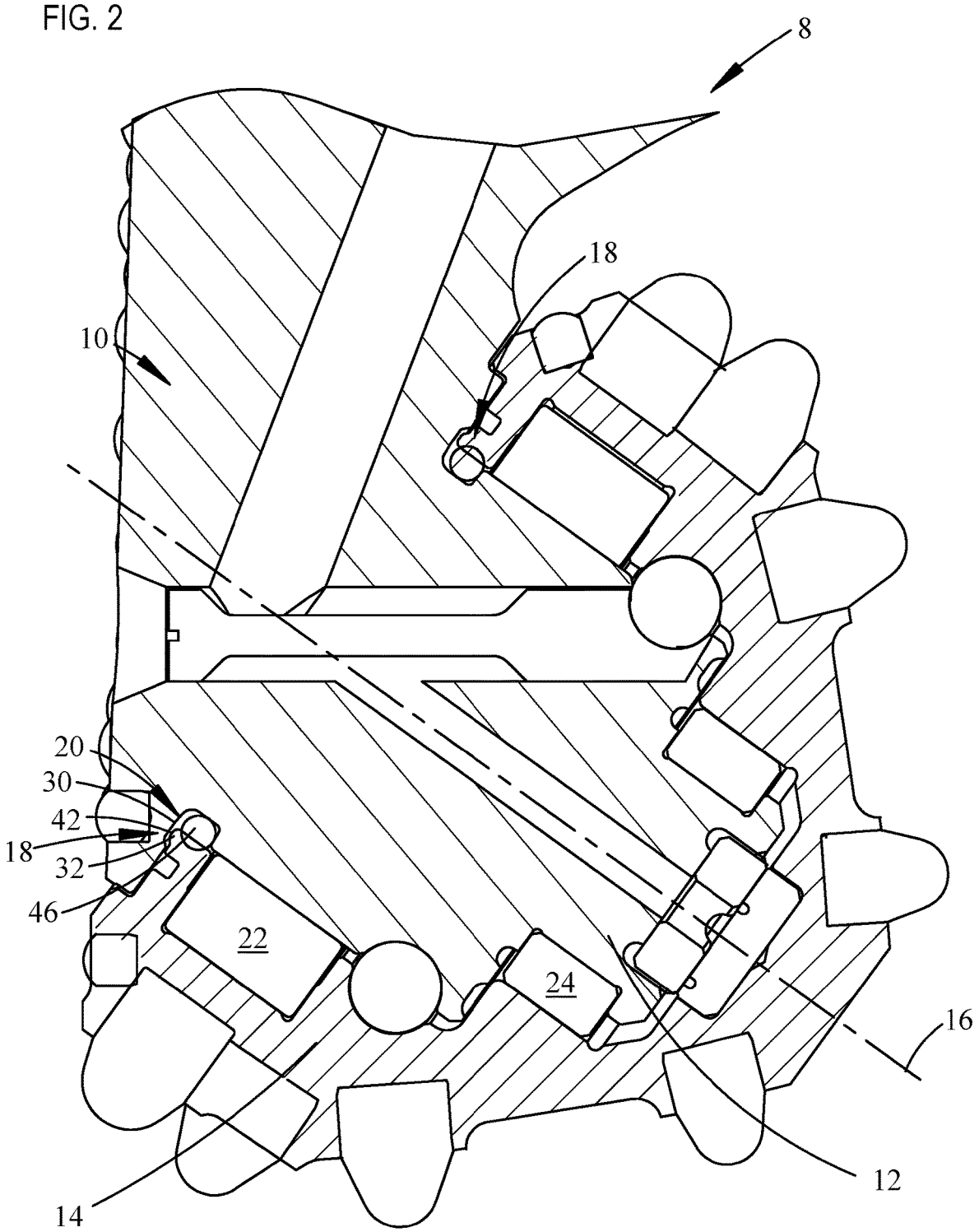

FIG. 2 is an enlarged, partial longitudinal section view of the leg 10 of the sealed bearing rock bit 8 of FIG. 1 showing the journal 12 extending downward and inward from the lower portion of the leg 10. The cutter 14 is rotatably mounted to the journal 12. The bearing seal 18 has a seal gland 20 which is located at the base of the journal 12. The seal gland 20 is provided by a seal groove 30 and seal surface 44 (shown in FIG. 4) of an annular shaped protrusion 32. The seal groove 30 is undercut into the last machined surface 38 of the journal 12 and provides a recess for receiving a seal element 46. The last machined surface 38 is part of the leg 10 and extends adjacent to the journal 22. A clearance 42 is provided by a space located between the terminal end of the annular-shaped protrusion 32 and the surface of the seal groove 30. The seal groove 30, the protrusion 32 and the seal element 46 each have continuous annular shapes which extend circumferentially around the axis 16 of the journal 12. The seal element 46 is preferably provided by an O-ring formed of elastomeric material which is compressed within the seal gland 20.

Figure 3:
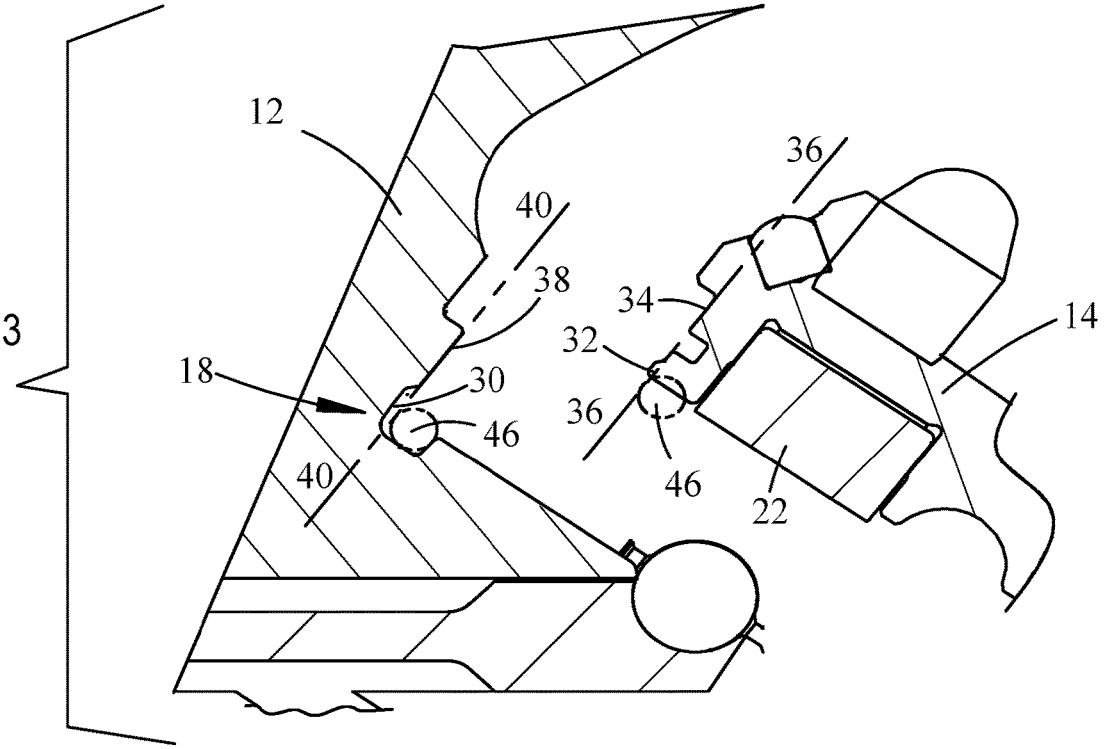
Figure 4:
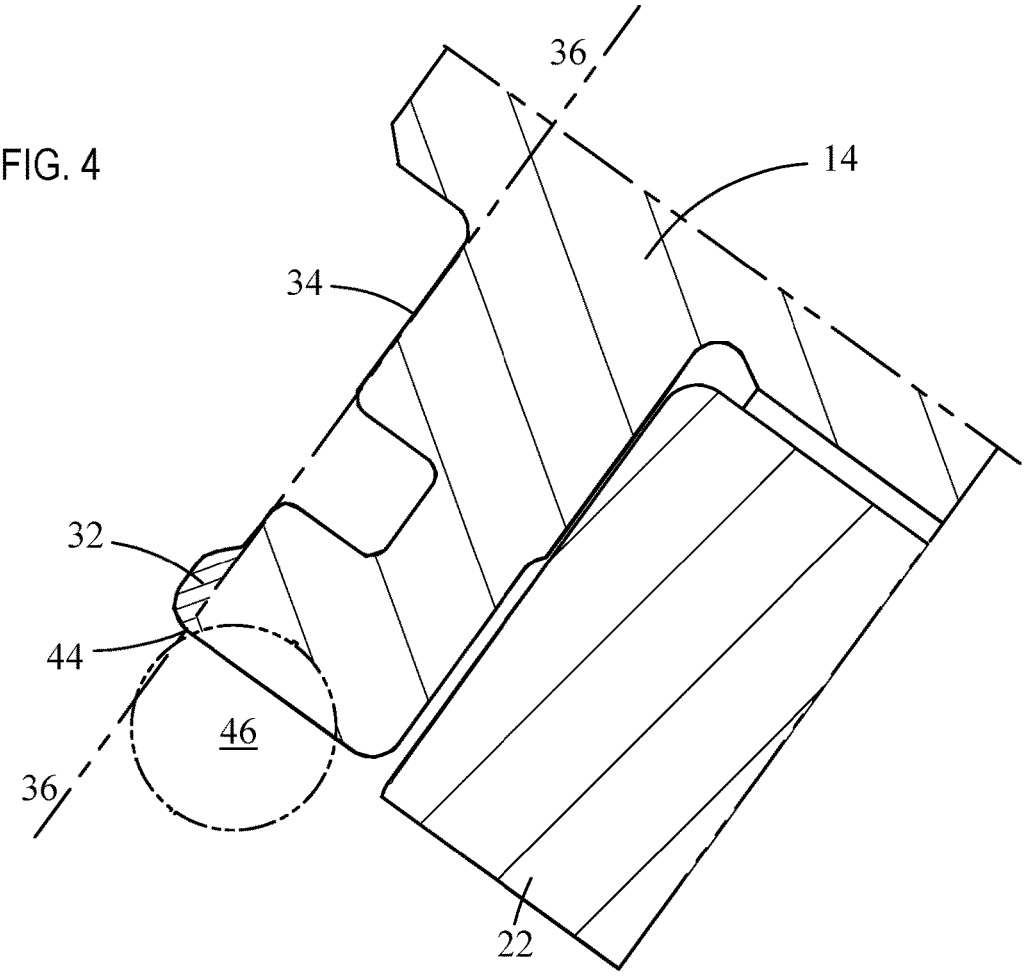

FIG. 3 is an exploded, partial, longitudinal section view of the base of the journal 12 and the back face 34 of the cutter 14. FIG. 4 is an enlarged partial section view of the cutter 14, showing a cross-section of the annular-shaped protrusion 32 which extends from the back face 34 of the cutter 14 for inserting into the seal groove 30. The protrusion 32 is preferably integrally formed with the cutter 14, machined directly into the cutter 14 and extends circumferentially around a laterally disposed circumference of a terminal end of the cutter 14. The protrusion 12 is annular shaped and preferably extends contiguous with the outermost circumferential side of the body for the cutter 14, defining with the outermost circumferential side the terminal end of a seal surface 44 which is annular shaped and extends continuously around the cutter 14 defining an outermost terminal end for the cutter.

The annular-shaped protrusion 32 extends beyond the plane 36-36 of the back face 34. When the cutter 14 is assembled onto the journal 12, the annular-shaped protrusion 32 will extend into the seal groove 30, beyond the plane 40-40 of the last machined surface 38. The protrusion 32 extends a seal surface 44 which protrudes from the cutter back face 34 parallel to the longitudinal axis 16 for engaging the seal element 46, which increases the axial length along the axis 16 available for the bearing seal 18 and the roller bearings 22 and 24.

The present invention provides advantages of a low profile seal for a journal bearing in rotary cone rock bits. The journal bearing has a journal which is received in a rotary cutter and the seal extends between the base of the journal and the base of the cutter. A last machined surface is located on a surface of the bit body which is located adjacent to the journal. A seal groove provides an undercut which extends into the last machined surface, such that the seal groove takes up less space along the length of the journal. An annular-shaped protrusion extends from the back face of the cutter into the seal groove, extending the length of the seal gland an leaving more space along the journal to accept larger roller bearings between the cutter and the journal.

Although the preferred embodiment has been described in detail, it should be understood that various changes, substitutions and alterations can be made therein without departing from the spirit and scope of the invention as defined by the appended claims.

What is claimed is:

1. A sealed bearing rock bit having a plurality of legs with journals formed to inwardly extend at the end of the leg, the rock bit comprising:

each of the legs having a last machined surface located adjacent to the journals;

cutters rotatably mounted to respective ones of the journals, with back faces of the cutters located adjacent to and facing respective ones of the last machined surfaces of the legs;

seal grooves formed to extend into respective ones of the journals, at a base of each of the journals, said seal grooves being annular-shaped and circumscribing respective ones of the journals;

wherein the seal grooves are also formed to extend into respective ones of the last machined surfaces, adjacent to the journals, to define undercuts formed into respective ones of the last machined surfaces; and the cutters each having an annular-shaped protrusion which extends beyond the back face of the cutters and into a respective one of said seal grooves, said annular-shaped protrusion extending beyond the plane of the respective last machined surface, and thereby extending a seal surface in which a seal engages between the journal and the cutter.

2. The sealed bearing rock bit according to claim 1, further comprising said seal grooves extending into respective circumferences of said journals disposed at said bases of said journals, adjacent said last machined surfaces of said legs.

3. The sealed bearing rock bit according to claim 1, wherein said seal grooves are each one continuous groove extending into a junction of the last machined surface and the base of a respective one of the journals.

4. The sealed bearing rock bit according to claim 1, wherein said seal is an O-ring formed of elastomeric materials.

5. The sealed bearing rock bit according to claim 1, further comprising roller bearings operatively extending between said journals and said cutters for rotatably supporting said cut cutters on respective ones of the legs.

6. The sealed bearing rock bit according to claim 1, wherein said protrusions each have outmost inner ends which are arcuately shaped.

7. The sealed bearing rock bit according to claim 6, wherein outermost ends of said protrusions are spaced apart from said seal grooves, providing clearances there-between.

8. A sealed bearing rock bit having a plurality of legs with journals formed to inwardly extend at the end of the leg, the rock bit comprising:

each of the legs having a last machined surface located adjacent to the journals;

cutters rotatably mounted to respective ones of the journals, with back faces of the cutters located adjacent to and facing respective ones of the last machined surfaces of the legs;

seal grooves formed to extend into respective ones of the journals, at a base of each of the journals, said seal grooves being annular-shaped and circumscribing respective ones of the journals;

wherein the seal grooves are also formed to extend into respective ones of the last machined surfaces, adjacent to the journals, to define undercuts formed into respective ones of the last machined surfaces; and the cutters each having an annular-shaped protrusion which extends beyond the back face of the cutters and into a respective one of said seal grooves, said annular-shaped protrusion extending beyond the plane of the respective last machined surface and thereby extending a seal surface in which a seal engages between the journal and the cutter, and wherein outermost ends of said protrusions are spaced apart from said seal grooves, providing clearances there between, wherein annular-shaped protrusion extends parallel to a longitudinal axis of the journal about which the cutter rotates.

9. The sealed bearing rock bit according to claim 8, further comprising said seal grooves extending into respective circumferences of said journals disposed at said bases of said journals, adjacent said last machined surfaces of said legs.

10. The sealed bearing rock bit according to claim 8, wherein said seal grooves are each one continuous groove extending into a junction of the last machined surface and the base of a respective one of the journals.

11. The sealed bearing rock bit according to claim 10, wherein said seal is an O-ring formed of elastomeric materials.

12. The sealed bearing rock bit according to claim 11, further comprising roller bearings operatively extending between said journals and said cutters for rotatably supporting said cut cutters on respective ones of the legs.

13. The sealed bearing rock bit according to claim 12, wherein said protrusions each have outmost inner ends which are arcuately shaped.

14. A sealed bearing rock bit having a plurality of legs with journals formed to inwardly extend at the end of the leg, with each of the legs having a last machined surface located adjacent to the journals, and cutters rotatably mounted to respective ones of the journals, with back faces of the cutters located adjacent to respective ones of the last machined surfaces, and wherein each of the journals has a base which is located adjacent to one of the last machined surfaces of the legs, the improvement comprising:

seal groove extending continuously around respective ones of the journals and into respective ones of the last machined surfaces, disposed adjacent the last machined surface and the base of a respective one of the journals; and annular-shaped protrusions extending from respective back faces of said cutters, said annular-shaped protrusions extending from said respective back faces into respective ones of said seal grooves, beyond the planes of the last machined surfaces and thereby extending seal surfaces in which seals engage between the journals and the cutters, with outermost ends of said protrusions being spaced apart from said seal grooves and providing clearances there-between.

15. The sealed bearing rock bit according to claim 14, further comprising said seal grooves extending into respective circumferences of said journals disposed at said bases of said journals, adjacent said last machined surfaces of said legs.

16. The sealed bearing rock bit according to claim 14, wherein said seal is an O-ring formed of elastomeric materials.

17. The sealed bearing rock bit according to claim 14, further comprising roller bearings operatively extending between said journals and said cutters for rotatably supporting said cut cutters on respective ones of the legs.

18. The sealed bearing rock bit according to claim 14, wherein said protrusions each have outmost inner ends which are arcuately shaped, wherein the annular-shaped protrusions extend parallel to respective longitudinal axes of the journals about which the cutters rotate.

* * * * *